US006983796B2

(12) United States Patent
Bayne et al.

(10) Patent No.: US 6,983,796 B2
(45) Date of Patent: Jan. 10, 2006

(54) METHOD OF PROVIDING HYDRAULIC/FIBER CONDUITS ADJACENT BOTTOM HOLE ASSEMBLIES FOR MULTI-STEP COMPLETIONS

(75) Inventors: Christian F. Bayne, The Woodlands, TX (US); Benn A. Voll, Houston, TX (US); J. Todd Broome, The Woodland, TX (US); James R. Zachman, The Woodlands, TX (US); Graeme H. Falconer, Aberdeen (GB); Michael W. Norris, Cypress, TX (US); Edward J. Zisk, Jr., Kingwood, TX (US); David A. Bilberry, Houston, TX (US); Steve B. Hodges, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 812 days.

(21) Appl. No.: 09/754,879

(22) Filed: Jan. 5, 2001

(65) Prior Publication Data

US 2002/0007948 A1 Jan. 24, 2002

Related U.S. Application Data

(60) Provisional application No. 60/174,412, filed on Jan. 5, 2000.

(51) Int. Cl.

| | |
|---|---|
| ***E21B 43/04*** | (2006.01) |
| ***E21B 43/08*** | (2006.01) |
| ***E21B 23/03*** | (2006.01) |

(52) U.S. Cl. ..... 166/278; 166/51; 166/65.1; 166/385; 166/235; 439/190

(58) Field of Classification Search ..... 166/250.17, 166/338, 340, 341, 344, 381, 387, 278, 51, 166/65.1, 123, 181, 235, 385; 439/194, 190
See application file for complete search history.

(56) References Cited

U.S. PATENT DOCUMENTS 3,741,300 A * 6/1973 Wolff et al. ..... 166/184
4,783,995 A 11/1988 Michel et al.

(Continued)

*Primary Examiner*—Frank S. Tsay
*Assistant Examiner*—K. Thompson
(74) *Attorney, Agent, or Firm*—Steve Rosenblatt

(57) ABSTRACT

A technique for providing auxiliary conduits in multi-trip completions is disclosed. The technique has particular applicability to liner mounted screens which are to be gravel packed. In the preferred embodiment, a protective shroud is run with the gravel pack screens with the auxiliary conduits disposed in between. The auxiliary conduits terminate in a quick connection at a liner top packer. The gravel packing equipment can optionally be secured in a flow relationship to the auxiliary conduits so as to control the gravel packing operation. Subsequent to the removal of the specialized equipment, the production tubing can be run with an auxiliary conduit or conduits for connection down hole to the auxiliary conduits coming from the liner top packer for a sealing connection. Thereafter, during production various data on the well can be obtained in real time despite the multiple trips necessary to accomplish completion. The various completion and/or production activities can also be accomplished using the auxiliary conduits such as actuation of down hole flow control devices, chemical injection, pressure measurement, distributed temperature sensing through fiber optics, as well as other down hole parameters.

20 Claims, 13 Drawing Sheets

U.S. PATENT DOCUMENTS 4,919,201 A 4/1990 Bridges et al.
5,252,832 A 10/1993 Nguyen et al.
5,275,038 A 1/1994 Sizer et al.
5,295,733 A 3/1994 LeBegue
5,309,405 A 5/1994 Brett et al.
5,355,952 A * 10/1994 Meynier ..... 166/250.01
5,360,066 A 11/1994 Venditto et al.
5,386,875 A 2/1995 Venditto et al.
5,410,152 A 4/1995 Gadeken
5,443,119 A 8/1995 Chambers et al.
5,493,626 A 2/1996 Schultz et al.
5,570,437 A 10/1996 Kluth et al.
5,577,559 A 11/1996 Voll et al.
5,579,842 A 12/1996 Riley
5,582,064 A 12/1996 Kluth
5,667,023 A 9/1997 Harrell et al.
5,723,781 A 3/1998 Pruett et al.
5,767,411 A 6/1998 Maron
5,789,662 A 8/1998 Dayal
5,804,713 A 9/1998 Kluth
5,875,852 A 3/1999 Floyd et al.
5,892,176 A 4/1999 Findlay et al.
5,892,860 A 4/1999 Maron et al.
5,925,879 A 7/1999 Hay
5,963,317 A 10/1999 Hamid et al.
5,971,072 A * 10/1999 Huber et al. ..... 166/297
6,012,495 A 1/2000 Antonsen
6,026,897 A 2/2000 Pringle et al.
6,237,683 B1 * 5/2001 Pringle et al. ..... 166/66
6,296,066 B1 * 10/2001 Terry et al. ..... 175/92
6,298,921 B1 * 10/2001 Kobylinski ..... 166/380
6,302,203 B1 * 10/2001 Rayssiguier et al. ... 166/250.01
6,349,772 B2 * 2/2002 Mullen et al. ..... 166/387
6,464,004 B1 * 10/2002 Crawford et al. ..... 166/250.01
6,536,524 B1 * 3/2003 Snider ..... 166/297

* cited by examiner

METHOD OF PROVIDING HYDRAULIC/FIBER CONDUITS ADJACENT BOTTOM HOLE ASSEMBLIES FOR MULTI-STEP COMPLETIONS

CROSS REFERENCE TO RELATED APPLICATION

This nonprovisional U.S. Application claims the benefit of provisional application No. 60/174,412, filed on Jan. 5, 2000.

FIELD OF THE INVENTION

The field of this invention comprises methods of allowing the provision of conduits which can carry the power, signal, hydraulic, pressure, fiber optic cable, and other means of communication down to a bottom hole assembly where the completion requires multiple trips.

BACKGROUND OF THE INVENTION

In certain types of completions, a bottom assembly such as, for example, gravel pack screens are assembled as part of the liner and a liner top packer and installed in the well bore. Various operations thereafter occur involving specialized equipment. For example, cementing the liner and gravel packing the screens. After the completion of such steps with specialized equipment, the production string is then tagged into the liner-top packer so that production can begin. Due to the multi-stage nature of such operations, prior techniques for mounting auxiliary conduits to the assembly as it is put together at the surface were not workable. For example, in completions where the liner, liner top packer, and production tubing are inserted in a single trip, the auxiliary conduits can be assembled to the liner and production tubing as the assembly is being put together at the surface. With these types of single step installations, the auxiliary conduits could be extended to the desired location without the need to disassemble the auxiliary conduits because subsequent trips would be required for different specialized tools.

As previously stated, where the completion requires multiple steps and trips into the well bore, if auxiliary conduits are to be provided to the producing zone, techniques in the past have not been developed to allow that to occur.

More recently a technique has been developed which is subject to a co-pending patent application which is literally repeated as part of this specification, a technique has been developed to allow auxiliary conduits to be sealingly connected to each other down hole. The availability of this development, to solve a different problem, has opened up a possibility of allowing auxiliary conduits to run down to the producing formations adjacent to the bottom hole assembly. The method of this invention is a procedure whereby such auxiliary conduits can be used in conjunction with a variety of down hole operations such as, for example, gravel pack screens. The auxiliary conduits can be used for a variety of purposes such as actuation of down hole flow control devices, chemical injection, actuation of down hole proppant/chemical injection placement valves, distributed temperature data through fiber optic lines, the disposition of discrete sensors whether electric or fiber, pressure measurements, fluid characterization, and flow rate measurements to name a few. The auxiliary conduits can also be used in the gravel packing operation itself. Stated differently, the method of the present invention allows real time feed back of down hole conditions as certain completion operations are undertaken as well as the ability to sense the formation conditions during production. Accordingly, through the use of fiber optics, one of the objectives of the invention is to sense a variety of data at different times, for example, in a gravel pack completion. The fiber optic cables can be used to sense through pressure impacting them the distribution of the gravel during the gravel packing operation. It can also detect changes in the formation down below during production. Thus, another objective of the invention through the incorporation of the fiber optic technology is to be able to take measurements such as density, impaction, and other physical characteristics of a gravel pack through the use of electrical or fiber optic sensors integrated with screens located in the gravel pack itself. Some of the variables that can be measured with the technique are strain temperature, vibration, pressure, and density to name a few.

Accordingly, it is the objective of the present invention to provide a method whereby auxiliary conduits can be instrumental in the performance of various operations essential to the completion as well as to provide data on a real-time basis of down hole conditions during production particularly in multi-step completion involving multiple trips into the well bore where prior techniques have not allowed auxiliary conduits to extend to the producing zones below a liner top packer, for example.

The following U.S. Patents relate to down hole sensing and also include the use of fiber optics as the sensing devices: U.S. Pat. Nos. 5,925,879; 5,804,713; 5,875,852; 5,892,860; 5,767,411; 5,892,176; 5,723,781; 5,789,662; 5,667,023; 5,579,842; 5,577,559; 5,582,064; 5,570,437; 5,443,119; 5,410,152; 5,386,875; 5,360,066; 5,309,405; 5,252,832; 4,919,201; and 4,783,995.

These patents generally relate to the need to measure parameters in the producing zones of oil, gas, and injection wells. The measurements are used to trace production flow, validate performance of the producing zones, and the equipment installed in those zones, and to optimize production. However, in situations involving multi-trip operations such as a gravel packing a well, such access was unavailable in the previously known devices. In some instances to compensate for this lack of ability to sense in the producing zone, production logging tools or memory logging tools were used. However, running these tools required interruption of production. While these tools provided data, it was only discrete snapshots of the production environment and such information was often provided at a significant direct and indirect cost. Accordingly, one of the objects of the present invention is to provide continuous on demand data to evaluate the performance and health of a well. This is particularly more critical in situations where the completion is complicated as is often used for horizontal and multilateral wells.

In the past companies such as Sensor Highway and Pruitt Industries have used control tubes as a means of deploying optical fiber as a distributed temperature sensor, DTS. A pump-down technique has been developed to deploy fiber optic cables in the control tubes. This technique is illustrated in U.S. Pat. No. 5,570,437.

Those skilled in the art will appreciate the scope of the method of the present invention by a description of the preferred embodiment which appears below.

SUMMARY OF THE INVENTION

A technique for providing auxiliary conduits in multi-trip completions is disclosed. The technique has particular applicability to liner mounted screens which are to be gravel packed. In the preferred embodiment, a protective shroud is run with the gravel pack screens with the auxiliary conduits disposed in between. The auxiliary conduits terminate in a quick connection at a liner top packer. The gravel packing equipment can optionally be secured in a flow relationship to the auxiliary conduits so as to control the gravel packing operation. Subsequent to the removal of the specialized equipment, the production tubing can be run with an auxiliary conduit or conduits for connection down hole to the auxiliary conduits coming from the liner top packer for a sealing connection. Thereafter, during production various data on the well can be obtained in real time despite the multiple trips necessary to accomplish completion. The various activities can also be accomplished using the auxiliary conduits such as actuation of down hole flow control devices, chemical injection, pressure measurement, distributed temperature sensing through fiber optics, as well as other down hole parameters.

DETAILED DESCRIPTION OF THE PREFERRED EMBODIMENT

The preferred embodiment of the method of the present invention relates to the ability to place auxiliary conduits or/and fiber optics near gravel pack screens. Those skilled in the art will appreciate that other applications for auxiliary conduits adjacent the producing formation are within the scope of this invention. Most applicable are multi-trip completion procedures where there is still a need for real time communication to the surface from the zone where the completion is taking place or where ultimately the production continues, or below.

Figure 12:
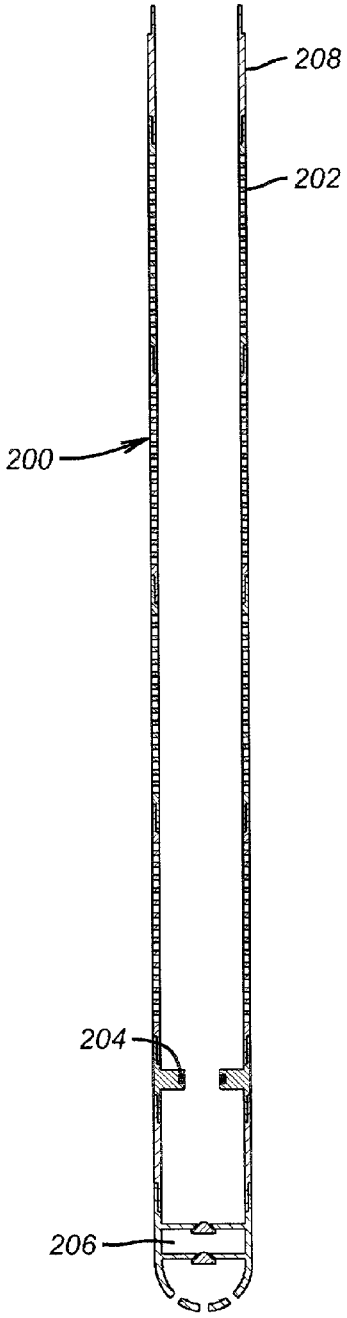
FIG. 12 is a sectional elevational view of the shroud assembly which can be optionally used.
Figure 13:
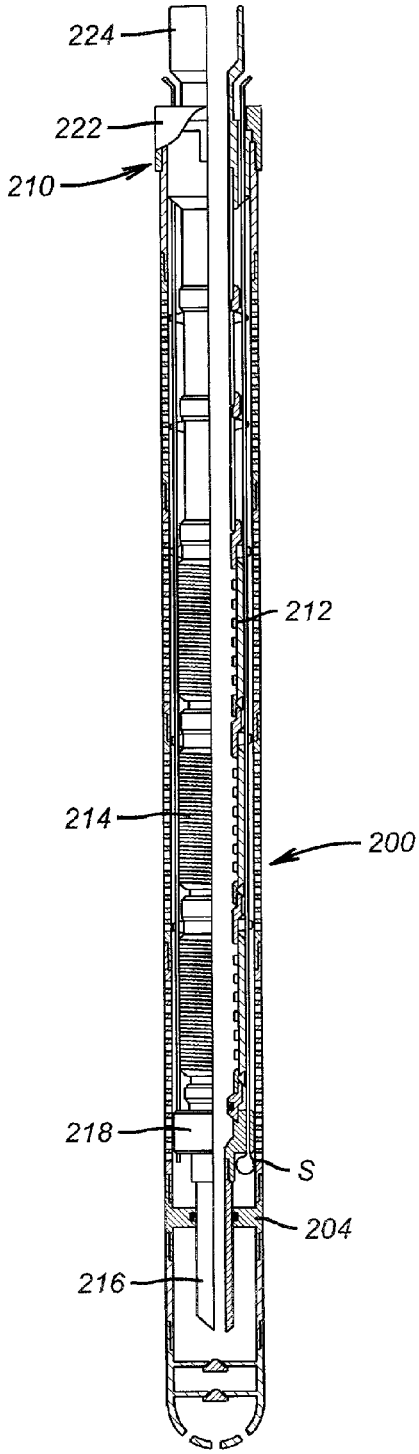
FIG. 13 is the sectional elevational view of the screen assembly assembled inside the shroud assembly of FIG. 12.
Figure 14:
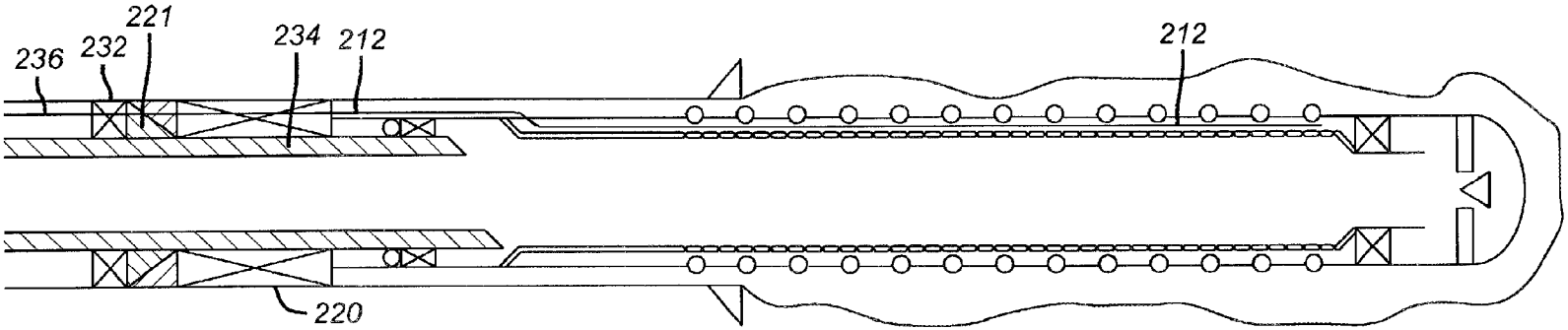
FIG. 14 is a sectional elevational view of the combined shroud and screen assemblies installed in a well bore with a liner top packer.
Figure 14A:
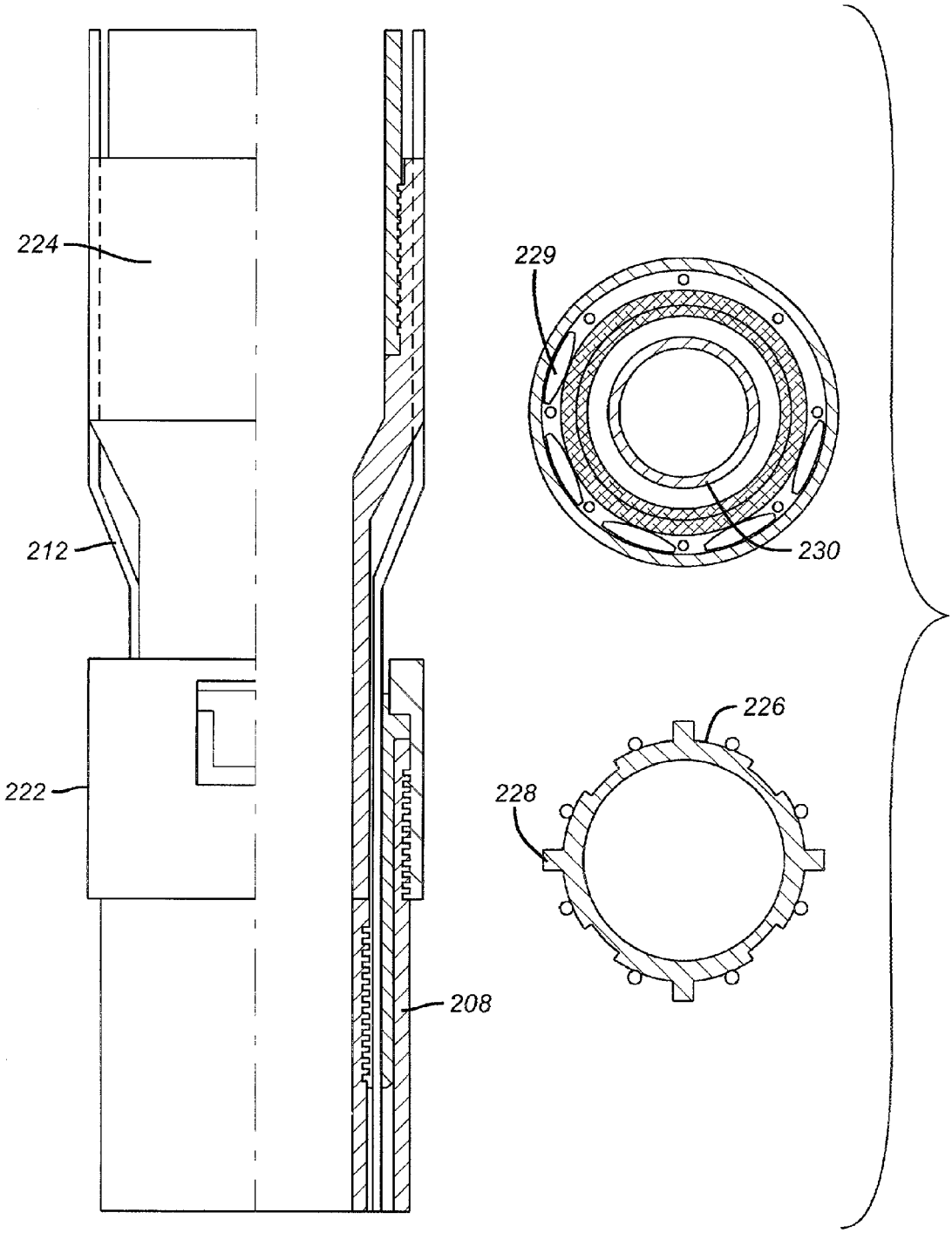
FIG. 14*a* is an elevational view including two sections showing the quick connection between the shroud and tubular.
Figure 15:
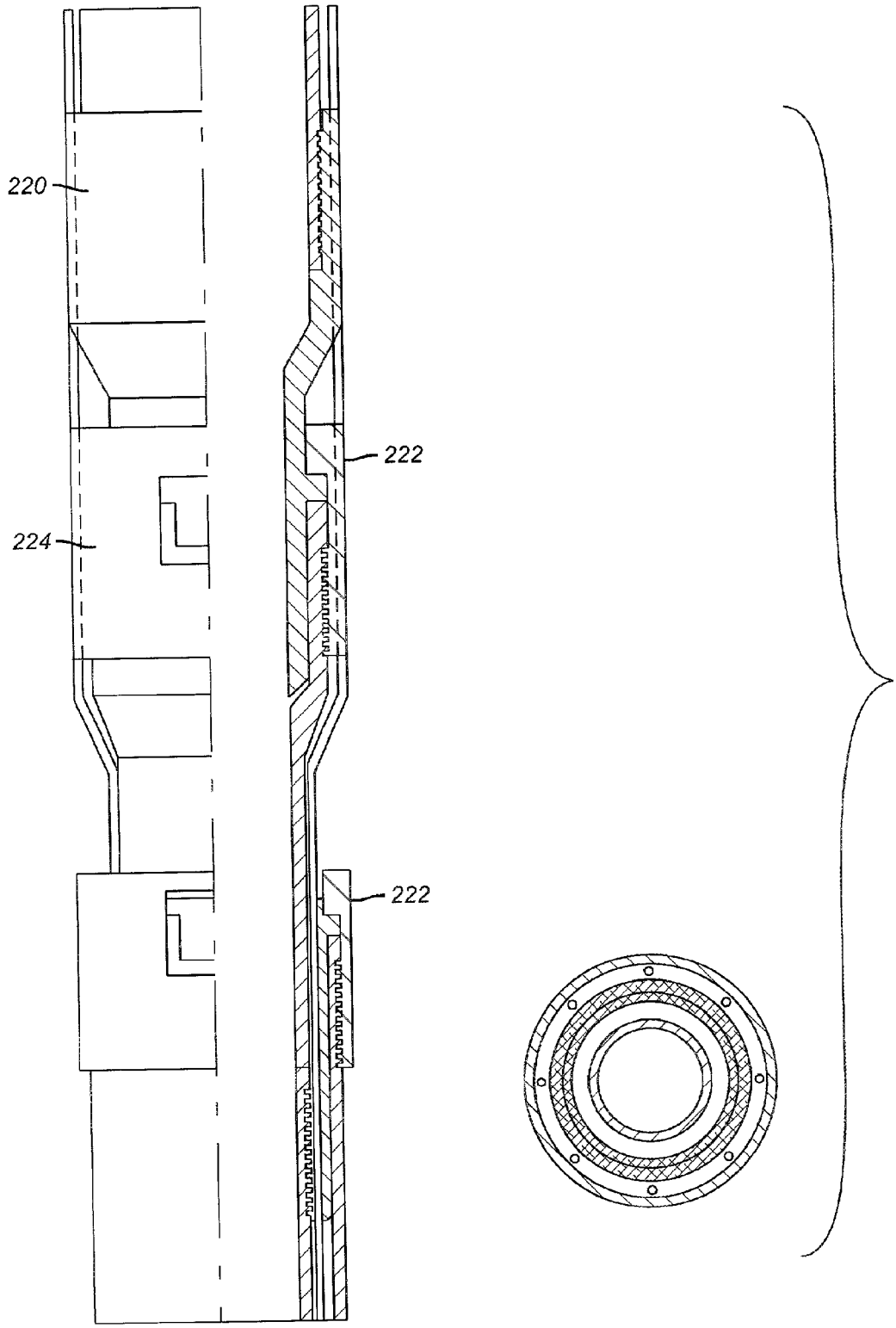
FIG. 15 is an elevational view with one section showing the use of two quick connections to connect a shroud to the tubular and a packer to the tubular on opposed ends.

In the preferred embodiment, a shroud assembly 200 shown in FIG. 12 is used. The shroud assembly is a pipe assembled in sections which has perforations 202 and an O-ring seal sub 204 near the lower end. Additionally, a set shoe 206 completes the shroud assembly 200. A landing nipple 208 is at the top of the shroud assembly 200 and is used for a quick connect to the screen assembly 210 shown in FIG. 14*a*. The detail of this quick connection is a design well known in the art such as is used on lubricators, adapted for this application. In essence, this quick connection allows a ready connection between two tubulars without rotation to facilitate auxiliary conduits disposed on the tubulars. Other modes of fixation of the shroud assembly 200 to the screen assembly 210 can be employed without departing from the spirit of the invention. In fact, the shroud assembly can be completely omitted and is optionally provided to further protect the auxiliary conduits, one of which 212 is shown in FIG. 13 disposed between the shroud assembly 200 and the gravel pack screens 214. FIG. 13 also shows a screen polished stinger 216 extending through the O-ring seal sub 204. The one auxiliary conduit 212 that is illustrated in FIG. 13 is indicated to go into a loop around sub 218. Thus, one or multiple conduits such as 212 can extend down to the O-ring seal sub 204 and can further turn and loop back up through a liner top packer assembly, the bottom of which is illustrated in FIG. 15 as 220. The liner top packer 220 is illustrated systematically in FIG. 14.

Those skilled in the art will appreciate that when the shroud assembly 200 is employed, it is assembled and supported from the rotary table. The screen assembly 210 is assembled into the shroud assembly 200 and they are joined at quick coupling 222, which is a known design. Referring to FIG. 14*a*, the details of the connection between the screen assembly 210 and the shroud assembly 200 are illustrated. The quick coupling 222 allows one or more conduits 212 to pass therethrough. These may be discrete conduits terminating a different end points or a single continuous conduit which loops around or other combinations of the above. FIG. 14*a* illustrates the landing nipple 208 which accommodates a portion of the quick coupling 222. The other portion of the quick coupling 222 is secured to the tubular 224. As seen in FIG. 13, the tubular 224 is ultimately connected to the screen or screens 214. In between the screen assembly 210 and the shroud assembly 200 a ring or rings 226 shown in FIG. 14*a* has a plurality of tabs 228 which help to centralize the screen assembly 210 in the shroud assembly 200. A plurality of tubes 229 run parallel to the conduits 212. Tubes 229 are big enough to conduct gravel to different depths to overcome bridging problems. Tubes 229 can have valves in them operated via conduits 212. Ultimately, when this assembly is put together shown in FIG. 13, a wash pipe 230 is inserted through the screens 214 and terminates near the stinger 216 shown in FIG. 13.

A known gravel packing assembly including a packer 220 (modified to accept the quick coupling 222) and crossover are inserted and the gravel pack is conducted. Communication to conduits 212 through packer 220 is possible as the gravel packing proceeds. The screen assembly 210 can be assembled to the shroud assembly 200, preferably at the surface and joined together without relative rotation. The assembled screen assembly 210 and shroud assembly 200 are then run into place with a liner top packer 220 as illustrated in FIG. 14. The liner top packer 220 has one or more conduits 212 extending therethrough. These conduits are or can be initially capped off when the packer shown in FIG. 14 is run into position. This can be accomplished by a removable bushing 232 shown schematically in FIG. 14. The bushing would cap off all conduits 212 which extend through the packer 220. However, as an alternative to the method of the present invention, the traditional equipment run down with the assembly shown in FIG. 14 to accomplish the gravel packing can also have communication with the conduit or conduits 212 through use of a connector 221 shown in FIGS. 1–3. Accordingly, during the gravel packing operation, real time data can be obtained at the surface as to conditions down hole using for example the fiber optic arrays shown in FIGS. 4–11. For example, the conduits 212 can include within or outside of them a fiber optic cable which can sense the relative compaction provided by the deposited gravel at different elevations along the screens 214. It should be noted that the perforations 202 on the shroud assembly 200 are sufficiently large to enable a close pack of gravel around the screens 214 in the area where the conduit or conduits 212 extend. Accordingly, the fiber optic cable can run the length of the screens 214 and give a profile of compaction of gravel per unit length. Additionally, pressure or temperature data can be obtained during the gravel packing operation. Yet another alternative is to control the manner of the deposition of gravel by operating a series of down hole valves in tubes 229 which will deliver gravel at different elevations. Alternatively, the conduits 212 can be made sufficiently large and can terminate at different depths so that valving on each such conduit 212 terminating at a different depth can be actuated by the hydraulic pressure delivered to valving through other conduits 212 so as to open flow paths for gravel deposition, for example. Yet another application is the ability to inject a variety of fluids through one or more conduits 212 in the vicinity of the screen during the completion or gravel packing operation.

Those skilled in the art will appreciate after the packer 220 is set, multiple trips are generally required to finish the gravel packing operation, using standard equipment and known techniques. The individual conduits provided by this invention can be utilized in the same manner on each of the successive trips or they may be used in differing manners depending on the requirements and equipment utilized during the completion and production phases of the well bore. The method of the present invention, however, allows the opportunity for communication through conduits such as 212 which can include the placement of fiber optics in the vicinity of the screens 214 and the communication of the data to the surface from the vicinity of the screen through signals of conditions sent through the fiber optic network surrounding the screens 214, in the various embodiments as will be described below in FIGS. 4 through 11. The ability to ultimately run a production string shown schematically as 234 in FIG. 14, along with its set of conduits 236 which match perfectly the conduit or conduits 212 which extend through the packer 220 allows for connection though auxiliary conduits which then extend from the surface to the area of the screens 214, without the need for rotation. Screens are but one application, other liners such as slotted can also be used or a variety of bottom hole assemblies. In many such applications, the well bores are deviated or horizontal making connection by rotation difficult or impossible. However, using the reconnector 221 as illustrated in more detail in FIGS. 1 through 3 all the conduits 236 can be sealingly mated to their corresponding conduits 212 which extend through packer 220 without relative rotation. There thus is now a way to allow one or more conduits to extend from the surface to the zone or zones where production will be initiated or resumed or below and, more particularly, in situations where there are multiple trips into the well bore during the completion. Those skilled in the art will appreciate the connection of the auxiliary conduits 236 to their corresponding conduits 212 extending through the packer 220 can be accomplished on multiple occasions and with different strings and on different trips.

As shown in FIG. 15, a known quick connection or coupling such as 222 can be employed also to connect the packer 220 to the tubular 224. This is shown schematically in FIG. 15. The liner top packer 220 can be assembled to the tubular string 224 at the surface or downhole using the quick coupling 222.

As shown in FIG. 15, the quick coupling 222 has uses in multiple applications. The packer 220 can alternatively be attached to the tubular string 224 by other techniques.

The ability to provide one or more conduits down to the producing zone in a completion which requires multiple trips in the well provides numerous benefits. It allows verification and optimization of the performance of a gravel pack completion. It allows a means to continuously monitor the performance of a gravel pack while the reservoir is being produced. The sensors shown schematically as "S" in FIG. 13 can be implemented via the conduits 212 to provide data on water breakthrough, fluid flow, and composition as well as equipment performance. The conduits 212 and the ability to control down hole functions or sense down hole conditions can span multiple producing zones and extend below all the producing zones. The technique is particularly applicable for complicated multi-trip completions. As illustrated in FIG. 13, the technique provides a way to place temporary and/or permanent sensors in gravel pack zones. The installation technique previously described allows the shroud assembly 200 the screen assembly 210 and the conduits 212 to be run in the well in a single trip. Another advantage is the ability to construct the conduits 212 and 236 shown in FIG. 14 in continuous length without the need for connectors or splices which thus eliminates potential points of failure. The conduits 212 provide a pathway for sensors such as fiber optics, electrical, mechanical, flowable, or chemical, chemical injection and hydraulic fluid control. Additionally, electrical and/or fiber optic connectors can be substituted for the control tubing connection to expand the types of sensors and operations available to the well operator. The bushing 232 is optional and the method of the present invention facilitates the ability to connect and disconnect the auxiliary conduits in a down hole location. Bushing 232 may be removed in a separate trip of with the gravel packing equipment. Standard equipment such as cross overs used for gravel packing can in fact be connected to the liner top packer 220 using the reconnector 221 of FIGS. 1–3 to enable real-time monitoring of the gravel packing operation particularly by use of remote or locally operated valving.

Depending on the size of the down hole equipment, five or more isolated conduits such as 212 can be provided. The nature of the down hole equipment can be diverse as discrete sensors or optical fibers can be used in different conduits 212 which obtain different types of data from a variety of locations at the same time and on a real-time basis. The shroud assembly 200 provides protection for the conduits 212 or the exposed fibers such as illustrated in FIGS. 4 through 11. Some of the sensors which can be employed can be used to actuate down hole flow control devices. The conduits 212 can be used for chemical injections or actuation of down hole proppant and/or to operate down hole chemical injection valves. The fiber optics can be used for distributed temperature profiles. Additionally, pressure profiles can be obtained or pressure delivered through the conduit or conduits 212 for operation of down hole equipment or fluid injection. Real-time data can also be obtained that allows for fluid characterization or flow rate measurements. The bushing 232 can act as a debris barrier upon installation of the assembly to the location as shown in FIG. 14.

Those skilled in the art will appreciate that the method of the present invention allows sensing of the early arrival of undesired fluid such as water, flash gas, into the log well bores, particularly in the horizontal well bore application. One of the disadvantages of known intelligent well systems and other monitoring systems involves costly on-the-fly joy stick control. However, since accurate monitoring is the overwhelming majority of the information needed for effective well control, the method of the present invention allows knowledge of what the well is doing at any given time and, therefore, allows for other remedial action such as optimized flow rate, altered water injections schemes, and other surface adjustments. Using on-off type methodology as opposed to sophisticated linear control, presents a simpler and more economical solution to the problem particularly in multi-trip completions.

Figure 16:
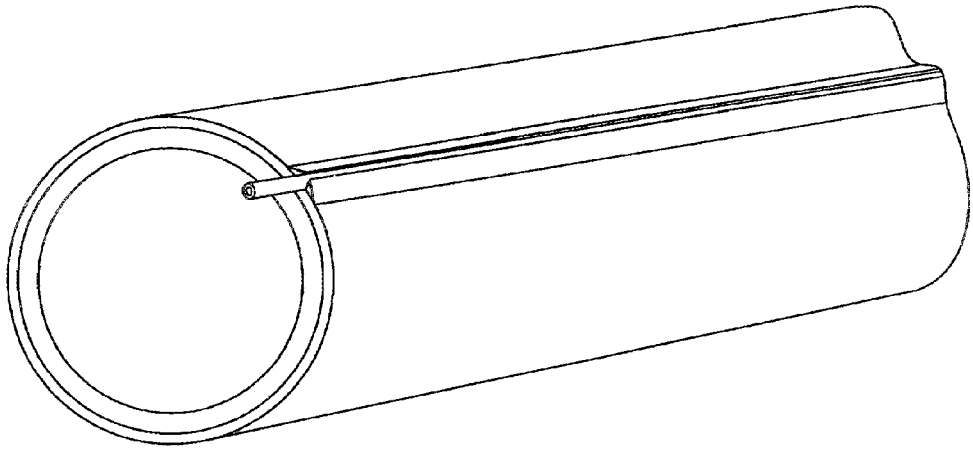
FIG. 16 is an alternative way to secure fiber optic cable to the tubular to measure longitudinal strains in the tubular.

The method of the present invention allows active monitoring of the quality of gravel pack both during gravel packing operations and throughout the life of the oil well. The technique is to measure density, compaction and other physical characteristics of the gravel pack through the use of electrical or fiber optic sensors that are integrated with the screen or located in the gravel pack itself. Typical parameters to be monitored include but are not limited to strain, temperature, vibration, pressure and density. In one embodiment, the optical fibers can be combined with strain sensors attached to the circumference of the sand control equipment in a configuration or pattern determined by the measurement density desired. Placement of sensors can provide full radius coverage generating a 360° stress profile where desired. The sensors can be installed to measure the changes and stresses of the screen or components of the screen during the gravel packing operation so as to track the progress and quality of the gravel pack. During production, the pressure applied to the screen and/or its outerjacket, if any, will be measured and localized as stress along the length of the circumference of the screen. This provides the operator with information on how the flow into the screen is progressing and also provides information as to the integrity of the well bore. Location and flow rate into the screen or shroud can be characterized both along the length of the tools and circumferentially by virtue of real time monitoring of the applied stresses. The integrity of the well bore can be measured by monitoring the value and location of the stresses applied to the screen or protective shroud due to partial or complete collapse of the well bore cavity. As shown in FIG. 16, the optical fiber can be adhered via adhesives to the surface of the structure to be monitored or the fibers may be imbedded within the structure or the fibers can be encapsulated in a carrier coupled to the structure. FIG. 16 illustrates the trough into which the fiber is deposited. The optical sensing fiber can be encapsulated in a small metal or plastic or extruded tube that can be wedged or swedged into a mating receptacle groove on the exterior or interior of the structure. This leaves the fiber tightly coupled to the wall of the tube so as to transmit strain from the exterior of the tube into the sensing fiber. In this manner, the sensing element can achieve a high degree of coupling and allow for automated installation of a very long continuous length of sensing element which spans multiple screens and shrouds if used.

A variation of this method would be to only loosely couple the fiber in the encapsulating tubing so as no external strain is transmitted to the fiber. As the tubing or drill stem is deployed into the well bore, very long lengths of the tubing could be automatically swedged onto the outside of the drill stem or tubing to provide a connector free fiber optic path to downhole devices such as motors, LWD, MWD, and gravel packers. When the drill stem or tubing is retrieved from the well bore, the communication tubing could be automatically removed from the tubing and stored for later reuse.

The optical strain sensor system with or without temperature compensation can incorporate one or multiple optical fibers with discreet sensors, one or multiple optical fibers with more than one optical strain sensor multiplexed into each fiber or one or multiple distributed strain sensors in which the strain of the fiber is measured directly in the fiber.

The electrical embodiment of the system is to substitute and/or combine the electrical sensors and systems for the fiber optic systems in the above embodiments to monitor the completion and operation of the sand control equipment.

Figure 17:
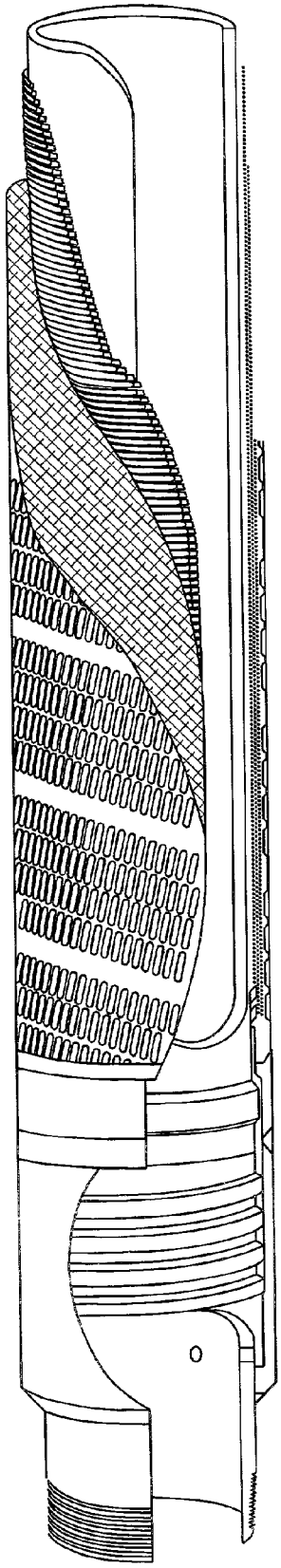
FIG. 17 is a perspective view of a well screen with an inlet helix which a fiber optic cable can be inserted so the assembly operates as a two-phase flow meter.

In yet another embodiment of the method of the present invention, the fibers can be inserted into helical inlet channels used in conjunction with gravel pack screens to optimize production and delay water or gas coning in long, low-drawdown, high-rate horizontal wells. This product sold by Baker Hughes under the name Equalizer™ has in each segment of gravel pack screen an inlet helix. With fiber optics disposed in such a helix, the ability to sense differing densities in the flowing stream can be used to determine the composition of the inflowing stream into its separate gas or liquid components. The screen component just described is illustrated in FIG. 17 and the disposition of the fiber optic can be in the helix illustrated at the bottom of the figure using techniques of the method described above so as to detect two-phase flow being produced from the formation The nature of the quick coupling 22 will now be described.

Figure 1A:
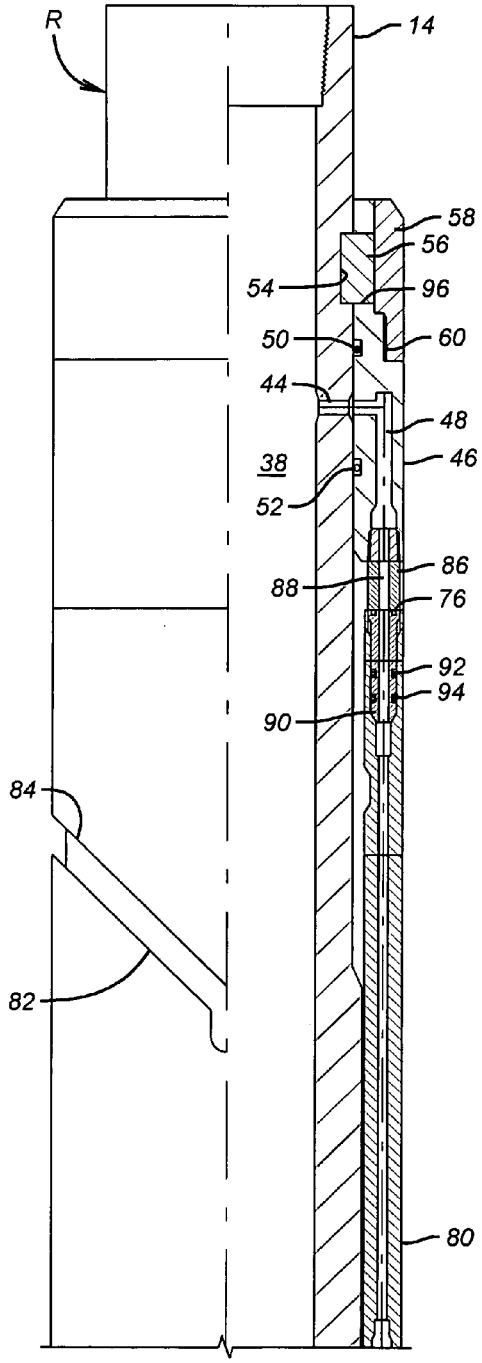
FIGS. 1*a–c* are a sectional elevational view of the outer or lower portion of the connector with the running tool inserted therein.
Figure 1B:
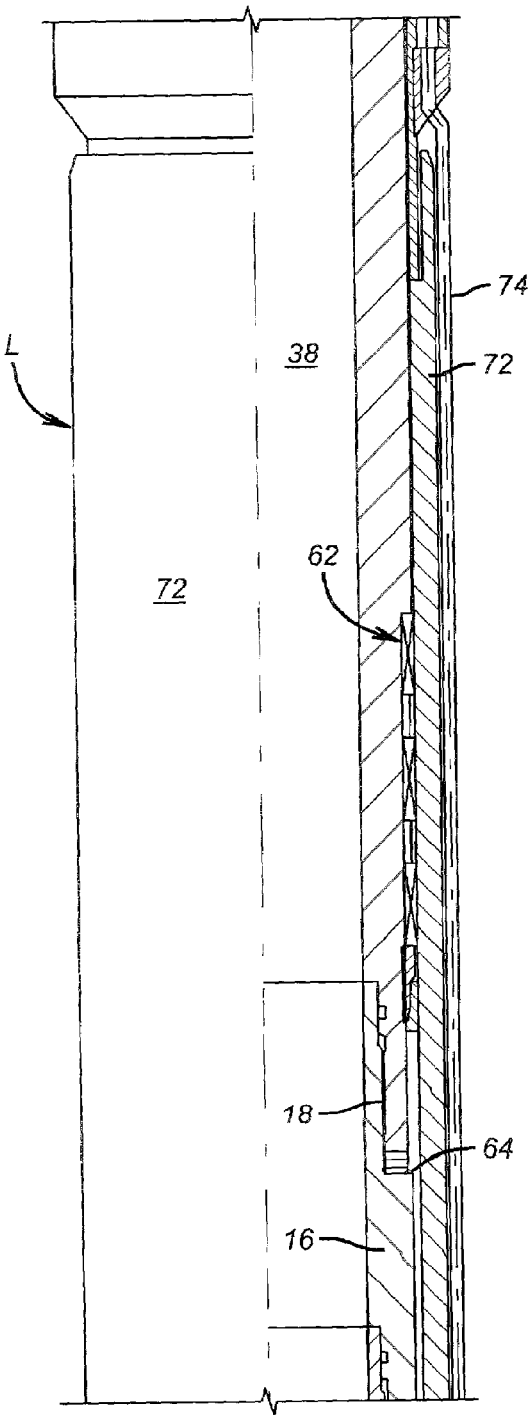
Figure 1C:
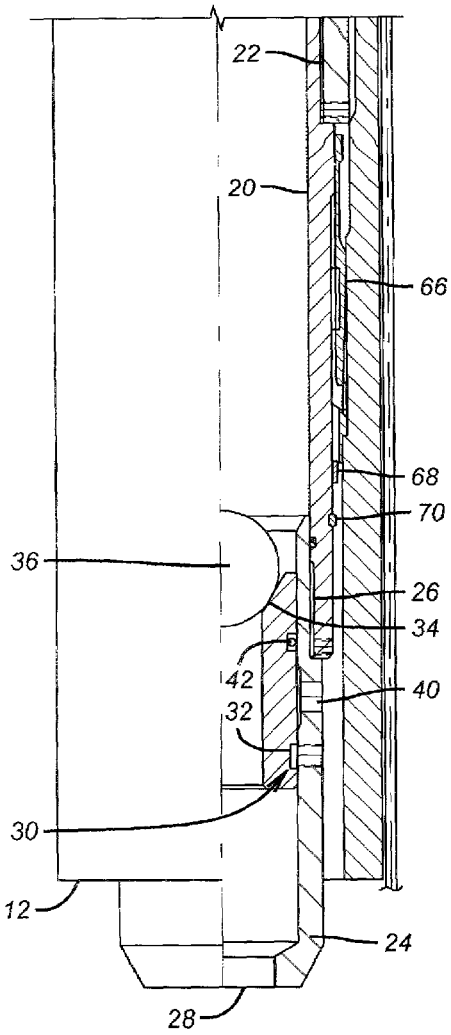

Referring to FIGS. 1*a–c*, the running tool R is shown fully inserted into the lower body L of the connector C. The lower body L has a thread 10 at its lower end 12, which is best seen in FIG. 2*c*. Thread 10 is connected to the bottomhole assembly, which is not shown. This bottomhole assembly can include packers, sliding sleeves, and other types of known equipment.

The running tool R is made up of a top sub 14, which is connected to a sleeve 16 at thread 18. Sleeve 16 is connected to sleeve 20 at thread 22. Sleeve 22 is connected to bottom sub 24 at thread 26. Bottom sub 24 has a bottom passage 28, as well as a ball seat assembly 30. The ball seat assembly 30 is held to the bottom sub 24 by shear pin or pins 32. Although a shear pin or pins 32 are shown, other types of breakable members can be employed without departing from the spirit of the invention. The ball seat assembly 30 has a tapered seat 34 to accept a ball 36 to build pressure in internal passage 38. Bottom sub 24 also has a lateral port 40 which, in the position shown in FIG. 1*c*, is isolated from the passage 38 by virtue of O-ring seal 42. Those skilled in the art will appreciate that during run-in, the ball 36 is not present. Accordingly, passage 38 has an exit at the passage 28 so that the bottomhole assembly, which is supported off the lower end of the lower body L, can be run in the hole while circulation takes place. Eventually, the bottomhole assembly is stabbed into a sump packer (not shown), which seals off the circulation through passage 38. It is at that time that the ball 36 can be dropped onto seat 34 to close off passage 38. At that time, O-ring 42 prevents leakage through the port 40, allowing pressure to be built up in passage 38 above the ball 36. This pressure can be communicated through a lateral port 44, as seen in FIG. 1*a*, into orientation sub 46. Orientation sub 46 has a passage which makes a right-angle turn 48 extending therethrough. Seals 50 and 52 prevent leakage between orientation sub 46 and the running tool R.

The running tool R also has a groove 54 to accept a dog 56 which is held in place by assembly of retaining cap 58, as will be described below. When retaining cap 58 is secured to orientation sub 46 at thread 60, with dog 56 in place in groove 54, the running tool R is locked in position with respect to orientation sub 46.

Looking further down the running tool R as shown in FIG. 1*b*, a seal assembly 62 encounters a seal bore 64 to seal between the lower body L and the running tool R. A locking ratchet assembly 66, of a type well-known in the art, is located toward the lower end of the running tool R. The ratchet teeth in a known manner allow the running tool R to advance within the lower body L but prevent removal unless a shear ring 68 is broken when contacted by a snap ring 70 after application of a pick-up force.

The lower body L includes a tubular housing 72 which, as previously stated, has a lower end 12 with a thread 10 for connection of the bottomhole assembly. In the preferred embodiment, a pair of control lines, only one of which 74 is shown, run longitudinally along the length of the tubular housing 72. The control line 74 terminates at an upper end 76 with a receptacle 78. In order to make the control line connection, the control line 74 becomes a passage 80 prior to the termination of passage 80 in the receptacle 78. Passage 80 is shown in alignment with passage 48. This occurs because when the running tool R is made up to the lower body L, preferably at the surface, an alignment flat 82 engages a similarly oriented alignment flat 84. Alignment flat 82 is on the housing 72, while alignment flat 84 is on communication crossover 86. The crossover 86 contains a passage 88 which is an extension of passage 48. Passage 88 terminates in a projection 90, which is sealed into the receptacle 78 by O-rings 92 and 94, which are mounted to the projection 90. Although O-rings 92 and 94 are shown, other sealing structures are within the scope of the invention. In essence, the receptacle 78 has a seal bore to accept the seals 92 and 94. The orientation of the opposed flats 82 and 84 ensure that the crossover 86 rotates to orient the projection 90 in alignment with receptacle 78 as the crossover 86 is advanced over the running tool R. To complete the assembly after proper alignment, the running tool R is firmly pushed into the lower body L so that the seal 62 engages seal bore 64, and the locking ratchet assembly 66 fully locks the running tool R to the lower body L. At this time, the crossover 86, which is made up over the running tool R and is now properly aligned, has its projection 90 progress into the receptacle 78. Thereafter, the projection 90 is fully advanced into a sealing relationship into the receptacle 78 so that its passage 48 is in alignment with port 44. This orientation is ensured by alignment of a window 96 in the orientation sub 46 with the groove 54 on the top sub 14 of the running tool R. When such an alignment is obtained, the dog 56 is pushed through window 96 so that it partially extends into the window and partially into groove 54. At that time, the retaining cap 58 is threaded onto thread 60 to secure the position of the dog 56, which, in turn, assures the alignment of port 44 with passage 48. The running tool R is now fully secured to the lower body L of the connection C. Rigid or coiled tubing can now be connected to the running tool R at thread 14.

The bottomhole assembly (not shown), which is supported off the lower end 12 of the body 72, can now be run into position in the wellbore while circulation continues through passage 38 and outlet 28. Ultimately, when the bottomhole assembly is stabbed into a sump packer, circulation ceases and a signal is thus given to surface personnel that the bottomhole assembly has landed in the desired position. At that time, the ball 36 is dropped against the seat 34, and pressure is built up in IC passage 38 above ball 36. This pressure communicates laterally through port 44 into passage 48 and, through the sealed connection of the projection 90 in the receptacle 78, the developed pressure communicates into the control line 74 to the bottomhole assembly. Since, in the preferred embodiment, there are actually a pair of control lines 74, there are multiple outlets 44 in the running tool R such that all the control lines 74 going down to the bottomhole assembly and making a U-turn and coming right back up adjacent the tubular housing 72 and terminating in a similar connection to that shown in FIG. 1*a*, are all pressure-tested simultaneously. If it is determined that there is a loss of pressure integrity in the control line system 74 at this point, the bottomhole assembly can be retrieved using the running tool R or alternatively, the running tool R can be released from the lower body L and the bottomhole assembly can be retrieved in a separate trip. If, on the other hand, the integrity of the control line system 74 is acceptable, pressure can be further built up in passage 38 to blow the ball 36, with the ball seat assembly 30, into the bottom of bottom sub 24 where they are both caught. As a result, the port 40 is exposed so that pressure can be communicated to the bottomhole assembly for operation of its components, such as a packer or a sliding sleeve valve, for example. Once the bottomhole assembly is completely functioned through the pressure applied at port 40, an upward force is applied to the running tool R to break the shear ring 68 so that the entire assembly of the running tool R, along with the orientation sub 46 and the crossover 86, can be removed. As this pick-up force is applied, the projection 90, which is a component of the crossover 86, comes out of the receptacle 78 so that each of the control lines 74 (only one being shown) becomes disconnected as the running tool R is moved out completely from the lower body L.

Figure 2A:
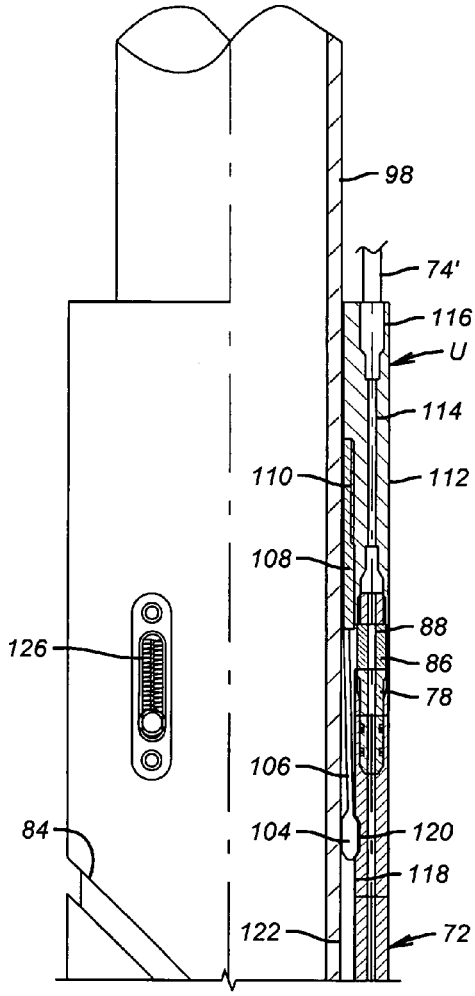
FIGS. 2*a–c* show both portions of the connector in sectional elevation connected to each other.

At this point the upper string 98, shown in FIG. 2*a*, which is connected to the upper body U, can be run in the wellbore for connection to the lower body L. Alternatively, the upper string 98 can be inserted at a much later time.

Figure 2B:
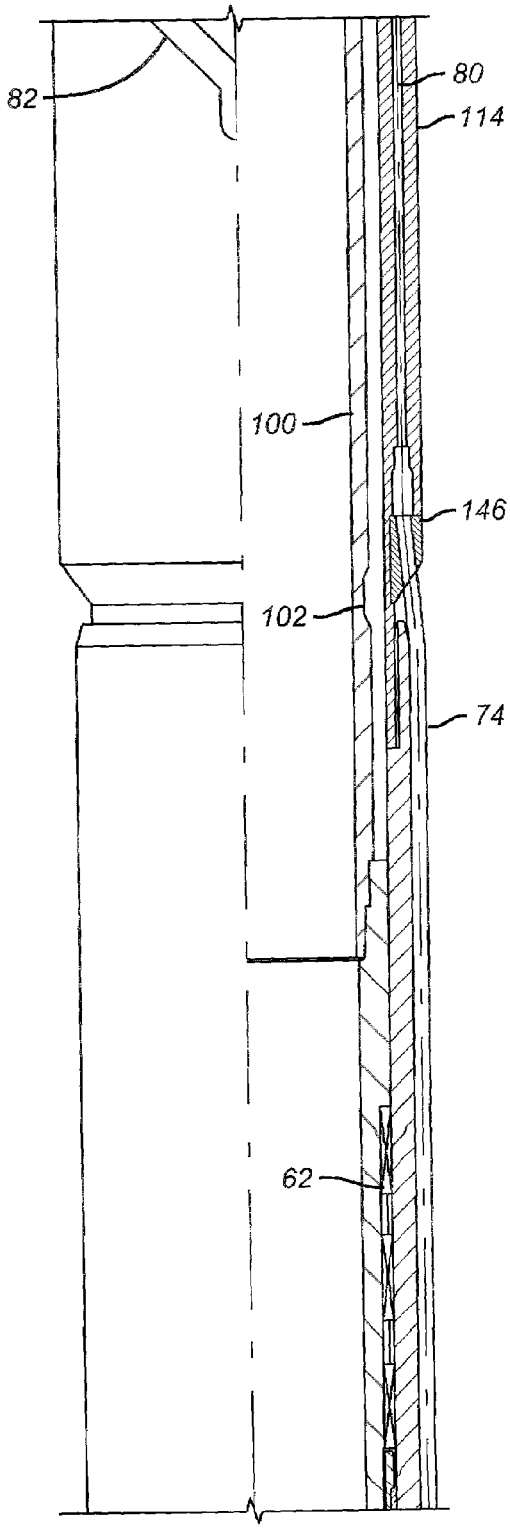
Figure 2C:
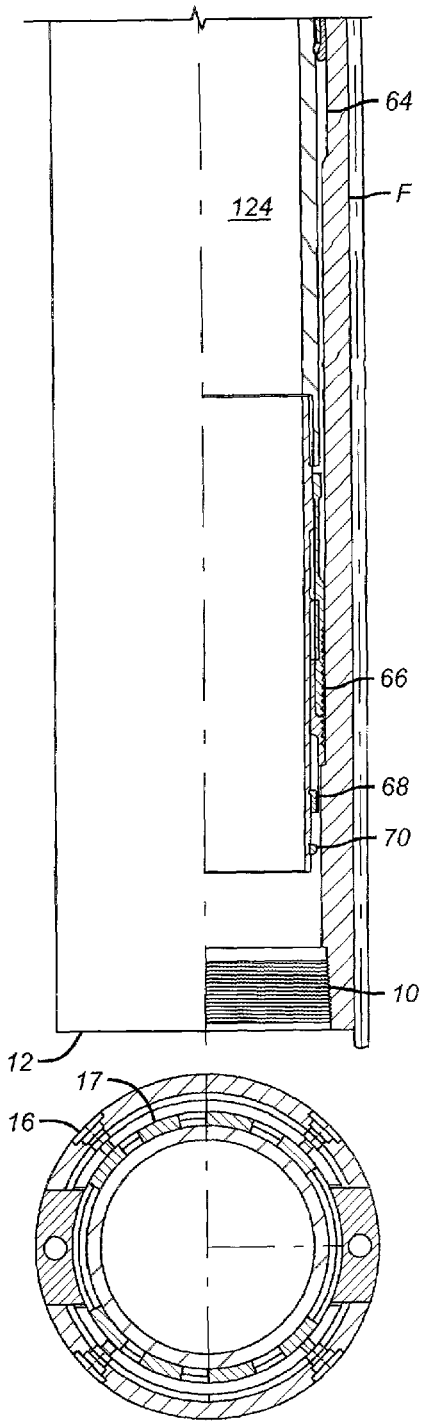
Figure 3B:
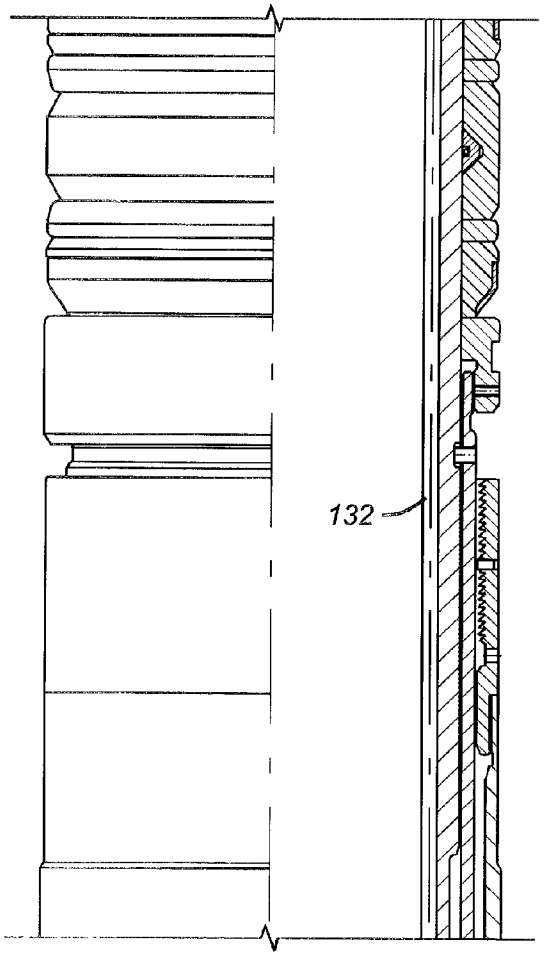
FIGS. 3*a–d* show a passage around a packer in sectional elevational view, indicating the path of the control line around the packer sealing and gripping assemblies.
Figure 3A:
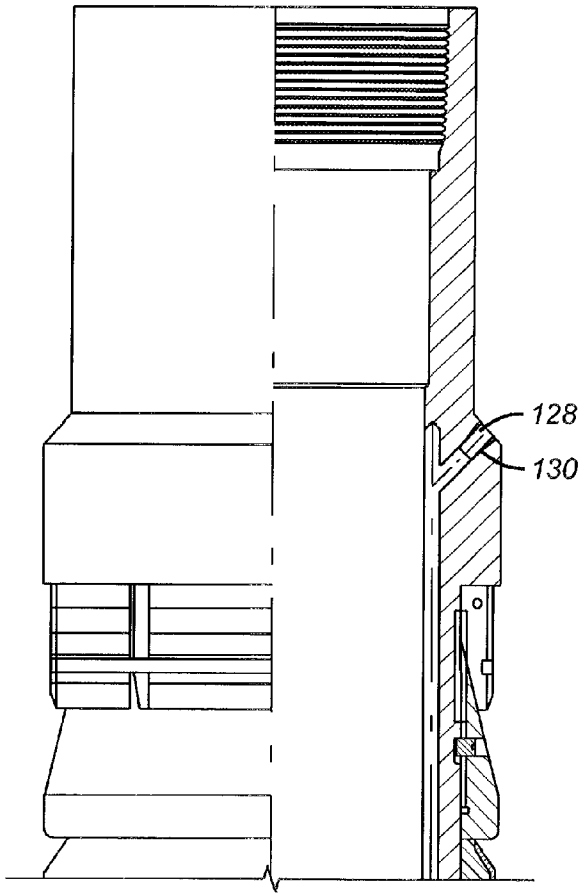
Figure 3D:
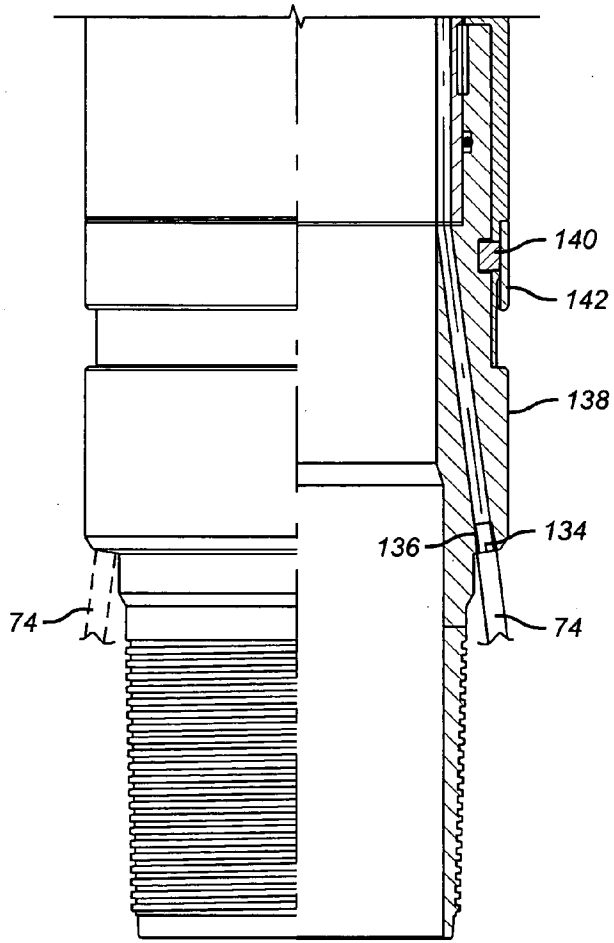
Figure 3C:
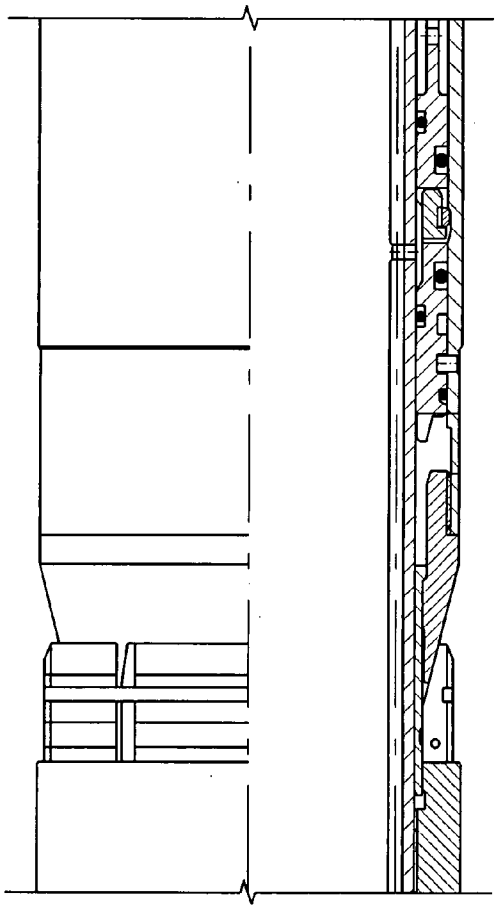

The upper body U has some constructional differences from the orientation sub 46 and the crossover 86 used in conjunction with the running tool R. Whereas the components 46 and 86 were assembled by hand at the surface, the counterpart components of the upper body U must connect automatically to the lower body L. Those skilled in the art will be appreciate that the view in FIGS. 2*a–c* is the view of the upper body U fully connected into the lower body L. However, there are certain components that are in a different position as the upper body U approaches the lower body L. The string 98 extends as a mandrel to support the upper body U and has numerous similarities to the running tool R which will not be repeated in great detail at this point. A seal assembly 62 contacts a seal bore 64, while a locking mechanism of the ratchet type 66 is employed in upper body assembly U, just as in the running tool R. Also present is a shear release in the form of an L-shaped ring 68, which for release is broken by a snap ring 70. The mandrel 100, which forms an extension of the upper string 98, includes an outer groove 102. During the initial run-in, a series of collet heads 104 is initially in alignment with groove 102. These collet heads 104 are held securely in groove 102 by sleeve 17 (shown in section in FIG. 2*c*). Sleeve 17 is pushed into this position by spring 126. The collet heads 104 extend from a series of long fingers 106, which in turn extend from a ring 108. Ring 108 is connected at thread 110 to orientation sub 112. Orientation sub 112 has a passage 114, including an upper end 116 which one of the accepts the control lines 74 which run from the surface to upper end 116 along the upper string 98. Again, it should be noted that a plurality of control lines 74 and 74 are contemplated so that when the upper body U is connected to the lower body L, more than one control line connection is made simultaneously. As previously stated, the control line from the surface 74 extends down to the upper end 116 and then becomes passage 114. A crossover 86 has a passage 88 which is in alignment with passage 114. As before, the alignment flat 82 on the tubular housing 72 engages an alignment flat 84 on the crossover 86. However, rotational movement about the longitudinal axis is still possible while the collet heads 104 are longitudinally captured in groove 102. This ability to rotate while longitudinally trapped allows the mating flats 82 and 84 to obtain the appropriate alignment so that ultimately, passage 80 can be connected to passage 88 as the projection 90 enters the receptacle 78, as described above. As this is occurring, the groove 102, with the collet heads 104 longitudinally trapped to it, comes into alignment with groove 120, thus allowing the collet heads 104 to enter groove 120 and subsequently become locked in groove 120 as a result of opposing surface 124. This is precisely the position shown in FIGS. 2*a* and 2*b*. Thus, as the connection is firmly made up connecting passage 114 to passage 80 by virtue of a sealed connection between the projection 90 and the receptacle 78, that position is locked into place as collet heads 104 become trapped against longitudinal movement into groove 120 which is on the tubular housing 72 of the lower body L. It is at that time that further longitudinal advancement of the upper string 98 allows the seal 62 to enter the seal bore 64 and ultimately the locking assembly 66 to secure the mandrel 100 to the lower housing 72. Thus, with seal assembly 62 functional, production can take place through the passage 124 in the mandrel 100. The seal assembly 62 in effect prevents leakage between the mandrel 100 and the tubular housing 72, which is a part of the lower body L.

When disconnecting, collet 104 drops into groove 102, and the connection alignment sub 112 and housing 72 start to move apart. To ensure the collet 104 remaining in the groove 102, sleeve 17 (shown in section in FIG. 2*c*) is pushed over the collet 104 by spring 126, locking it in place in the groove 102. The reverse procedure happens when reconnecting.

As shown in FIG. 2*c*, the control line 74 extends beyond the lower end 12 and can extend through a packer as illustrated in FIGS. 3*a–d*. The control line 74 is literally inserted into opening 128 and secured in place with a jam nut (not shown) threaded into threads 130. The control line 74 extends through a passage 132 and emerges out at lower end 134, where a jam nut (not shown) is secured to threads 136. To facilitate manufacturing, the lower end of the passage 132 extends through a sleeve 138. The passage through the sleeve 138 is aligned with the main passage 132 and the aligned position is secured by a dog 140, which is locked in position by a ring 142. Also shown in FIG. 3*d* in dashed lines is the return control line from the bottomhole assembly going back up to the surface, which passes through the packer shown in FIGS. 3*a–d* in a similar manner and preferably at 180° to the passage 132 which is illustrated in the part sectional view. The control line 74 shown in dashed lines comes back up into the lower body L and is connected to the upper body U in the manner previously described.

Those skilled in the art will appreciate what has been shown is a simple way to test the control line 74 adjacent to the bottomhole assembly without running the upper string 98 with its attendant control line segments. Once the lower portion of the control line 74 has been tested and determined to be leak-free, the running tool R illustrated in FIGS. 1*a–c* can be used to set downhole components. This is accomplished by exposing passage 40 to allow pressure communication to the bottomhole assembly through the running tool R. The running tool R is simply removed by a pull which breaks the shear ring 68 to allow a pull-out force to remove the running tool R from the lower body L. Thereafter, the upper body U, attached to the lower end of the upper string 98, is run in the wellbore with the remaining control lines 74. The connector self-aligns due to the action between the inclined flats 84 and 84. The orientation sub 112 and the crossover 86 of upper body U of the connection C are free to rotate within groove 104 to facilitate this self-alignment. The control line segments 74 are made up as a result of this alignment and the male/female connection is sealed, as explained above. More than one control line connection is made up simultaneously. As the male/female components come together in a sealed relationship, their position is locked as the collet heads 104 become trapped in the groove 120 of the tubular housing 72. Further advancement of the mandrel 100 relative to the trapped collet hears 104 results in seal 62 engaging the seal bore 64 and locking ratchet mechanism 66, securing the mandrel 102 to the tubular housing 72. At this time, the production tubing is sealingly connected as the seal assembly 62 seals between the mandrel 100 and the tubular housing 72. The control line 74, one of which is shown in FIGS. 2*a–c*, is connected as the male and female components provide a continuous passage when sealing connected through the boss 144 which contains the passage 80. Thus, the control line 74 requires a connection at the lower end 146 of the boss 144. The control line from the surface 74, as seen in FIG. 2*a*, also has a connection to upper end 116 of orientation sub 112. Thus, when the male and female components are interconnected as described above, a continuous sealed passage is formed, comprising of passages 114, 88, and 80, which extends from the upper end 116 of orientation sub 112 to the lower end 146 of boss 144.

Multiple connectors C can be used in a given string, and the control lines 74 can have outlets at different locations in the well. One of the advantages of using the connector C is that the bottomhole assembly can be run into the well and fully tested along with its associated control lines while the production tubing can be installed at a later time with the remainder of the control line back to the surface. The control line in one application can run from the surface and be connected downhole, as previously described. The control line 74 can continue through a packer through a passage such as 132. Generally speaking, the control line 74 will have a connection immediately above the packer. In multiple packer completions, since it is known what the distance between one packer and the next packer downhole is going to be, a predetermined length of control line can extend out the lower end 134 when the packer shown in FIG. 3 is sent to the wellsite. The rig personnel simply connect the control line 74 extending out the lower end 134 to the next packer below, and the process is repeated for any one of a number of packers through which the control line 74 must pass as it goes down the wellbore before making a turn to come right back up to the surface. One application of such a technique is to install fiber optic cable through the control line so that the fiber optic cable F can extend from the surface to the bottomhole assembly and back up again. Through the use of the fiber optic cable, surface personnel can determine the timing and location of temperature changes which are indicative of production of undesirable fluids. Therefore, on a real-time basis, rig personnel can obtain feedback as to the operation of downhole valves or isolation devices to produce from the most desirable portion of the well and minimize production of undesirable fluids. Fluid pressure can be used to insert or remove the fiber optic cable. There are numerous other possible uses for this technology to be used with other than fiber optic cable without departing from the spirit of the invention.

Those skilled in the art will appreciate that the orientation of the male/female components to connect the control line 74 downhole can be in either orientation so that the male component is upwardly oriented or downwardly oriented without departing from the spirit of the invention. The invention encompasses as connector which can be put together downhole and which is built in a manner so as to allow control line testing, as well as functioning of bottomhole components, without having run the upper string and its attendant control line. Thus, it is also within the scope of the invention to connect the control line to the upper string in a multitude of different ways as long as the connection can be accomplished downhole and the connection is built to facilitate the testing of the control line adjacent the bottomhole components, as well as the subsequent operation of the necessary bottomhole components, all prior to inserting the upper string. Those skilled in the art will appreciate that the preferred embodiment described above illustrates a push-together technique with an orientation feature for the control line segment of the joint. However, different techniques can be employed to put the two segments of the connector together downhole without departing from the spirit of the invention.

Any number of different pressure-actuated components can be energized from the control line 74, such as plugs, packers, sliding sleeve valves, safety valves, or the like. The control line, since it runs from the surface down to the bottomhole assembly and back to the surface, can include any number of different instruments or sensors at discrete places, internally or externally along its path or continuously throughout its length, without departing from the spirit of the invention. As an example, the use of fiber optic cable from the surface to the bottomhole assembly and back to the surface is one application of the control line 74 illustrated in the invention. Any number of control lines can be run using the connector C of the present invention. Any number of connectors C can be employed in a string where different control lines terminate at different depths or extend to different depths in the wellbore before turning around and coming back up to the surface.

Certain applications in the context of gravel pack screens in conjunction with fiber optics will now be described.

Figure 4:
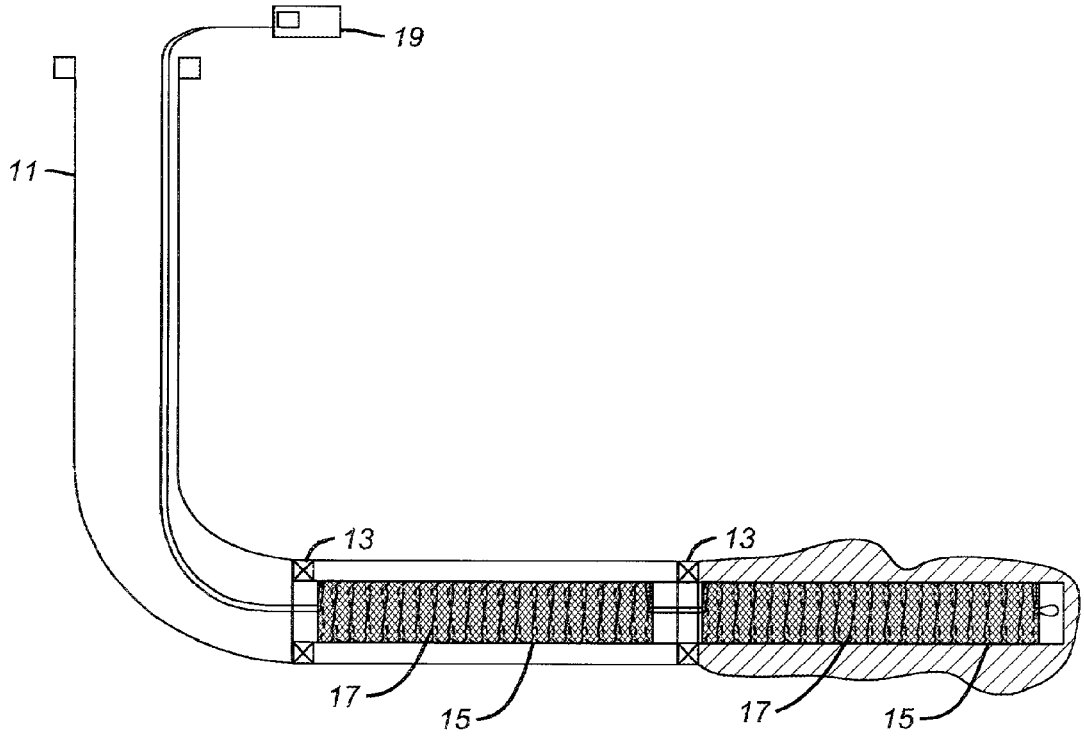
FIG. 4 is a schematic elevation view of a well bore having completion and sand control equipment installed therein, said control equipment having the optical fiber system integrated therein.

Referring to FIG. 4, one of ordinary skill in the art will recognize the depiction of a wellbore 11 and installed equipment therein. The equipment includes packers 13 and sand control devices 15 which may be of the added aggregate type or the no-added-aggregate type without affecting the function or components of the invention. Optical fibers 17 are also visible in FIG. 4. In order to appreciate the pattern of optical fibers in FIG. 4 reference is made to FIG. 5 wherein the wrapped fiber 17 is more easily appreciated. The density of the wrapped fiber 17 is dependent upon the spacial resolution of the fiber optic demodulator used in the invention. The equipment at issue is a fiber optic sensing demodulator 19 (FIG. 4) which is illustrated at the well head or the surface but which could be placed in an alternate location downhole, may, for example, require one meter of fiber to resolve a condition. in this case, the wrapping pattern must place one meter of the fiber in each area to be monitored. This may require that the fiber be densely wrapped or may allow a less dense wrap depending upon what is monitored. Likewise, a demodulator with higher resolution capacity might need only 0.25 meters in each location being monitored.

Figure 5:
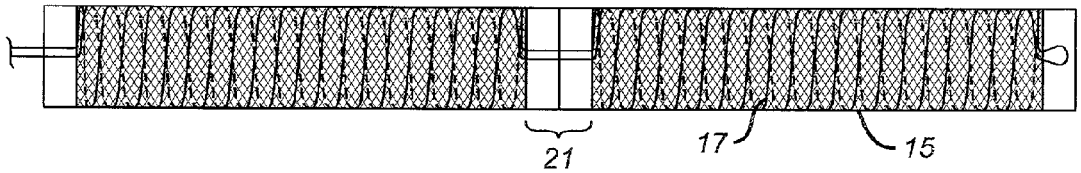
FIG. 5 is an enlarged view of a portion of FIG. 4 which illustrates the optic fibers wrapped around the sand control equipment.

Also visible in FIG. 5 is sand control equipment segment 15 joint area 21 where segments of sand control equipment are joined. Preferably in connection with the invention, the fiber 17 may be continuous or optically connected by a connector (not shown) over this joint area 21. Either method is acceptable and is dictated by circumstances rather than by function. One of ordinary skill in the art is equipped to determine which method is best for this particular application.

Figure 6:
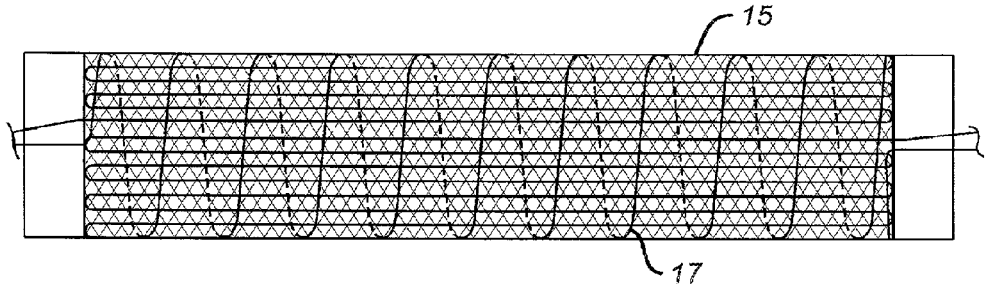
FIG. 6 is a view of an alternate wrapping pattern of the optic fibers.
Figure 7:
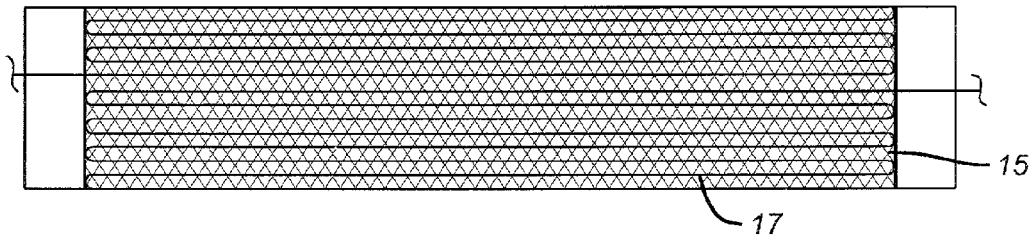
FIG. 7 is another alternate embodiment of the wrapping pattern of the optic fibers.
Figure 8:
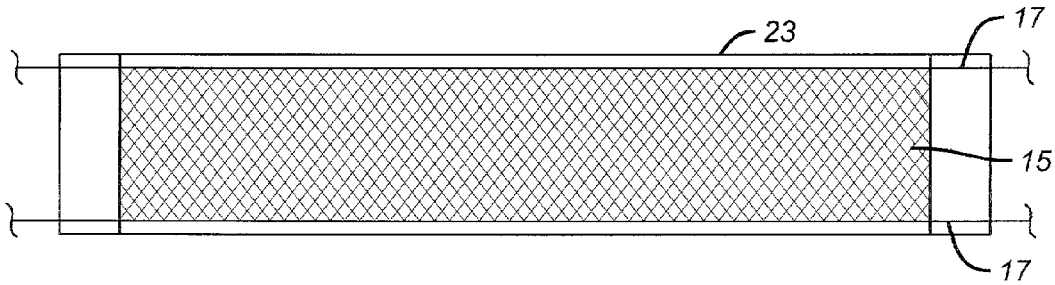
FIG. 8 is yet another alternate embodiment of the wrapping pattern of the optic fibers.

Referring now to FIG. 6, a very dense fiber optic pattern is illustrated which allows for monitoring of small locations on sand control equipment 15. The pattern employs both a zig-zag pattern and a longitudinal array of fiber 17. This may be the same fiber or different fibers. The embodiments of FIGS. 7 and 8 also provide varying density of monitoring, varying cost and complexity. FIG. 7 provides a longitudinally back and forth pattern of fiber 17 while FIG. 8 merely employs Fiber 17 in a conduit 22 at 0 and 180 degrees around the circumference of sand control equipment 15.

Figure 9:
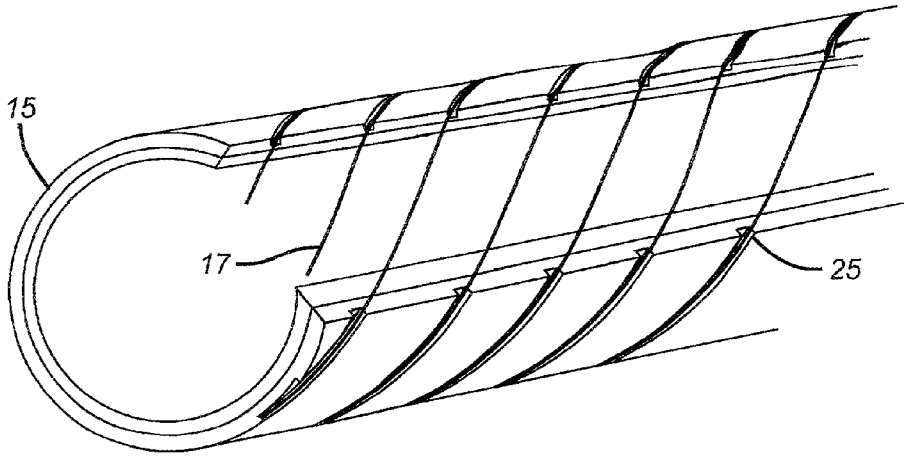
FIG. 9 is a perspective schematic view showing one arrangement for protecting the optic fibers.
Figure 10:
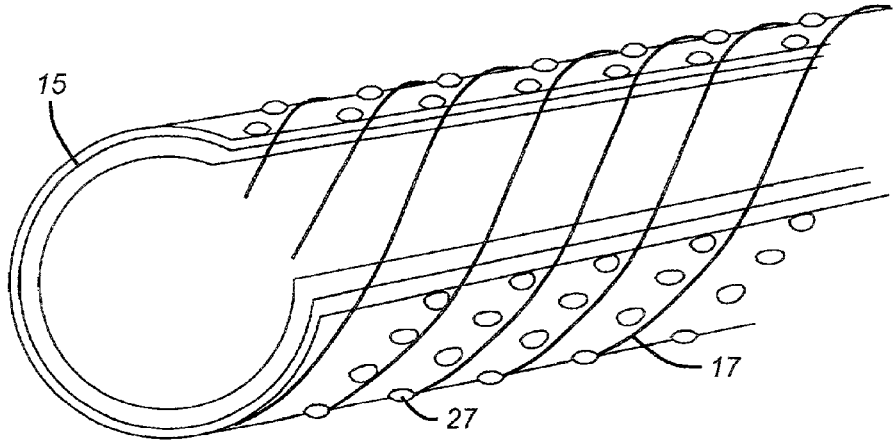
FIG. 10 is a perspective view showing an alternative arrangement for protecting the optic fibers.
Figure 11:
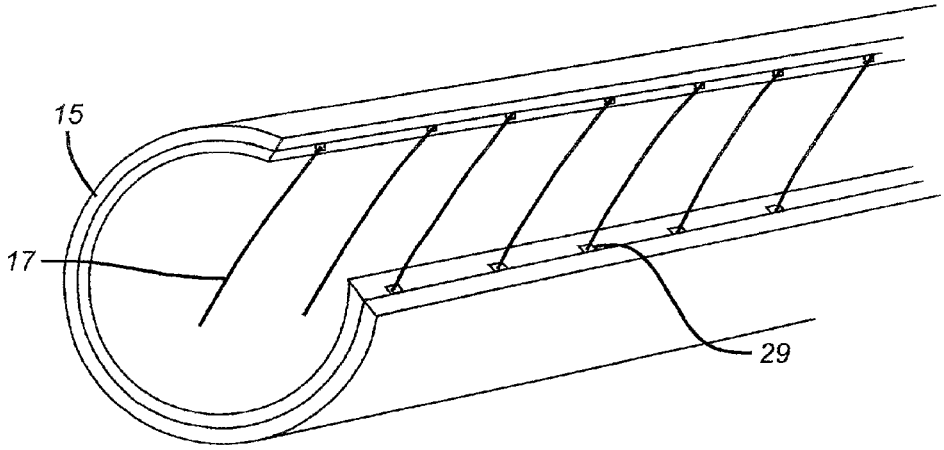
FIG. 11 is a perspective view showing another alternate arrangement for protecting the optic fibers.

Referring to FIGS. 9–11, it is important to note three alternative embodiments to protect the fiber during monitoring. Specifically referring to FIG. 9 first, sand control equipment 15 is provided with a groove 25 spiraling along the outside surface thereof. The groove 25 is preferably of dimensions at least slightly larger than the optical fiber to be used so that said fiber will be completely enveloped within the groove and therefore be protected from impact or abrasion during monitoring. In this embodiment the reduction capability of the demodulator to be employed must be known so that the groove 25 is at an appropriate spacing to render the system effective. In another embodiment, referring to FIG. 10, a plurality of raised portions (protuberances) 27 are extending from an outer surface of sand control equipment 15. The arrangement provides additional flexibility since the fiber 17 may be laid around the circumference of the equipment 15 in whatever density it is needed. Many different density levels are possible with the embodiment of FIG. 10 while maintaining a protective environment for fiber 17. A third protective environment for fiber 17 is illustrated in FIG. 11. In this embodiment the fiber 17 is actually housed within the sand control equipment 15 in a conduit 29. Conduit 29 need only be large enough to house fiber 17 without deforming the same.

In operation, the invention effectively and actively monitors the installation of sand control equipment, its integrity over time and the performance of that equipment. During installation, an exact depth of the sand control equipment is obtainable using a discrete optical signature in the fiber at the location of the downhole equipment and the length of the fiber optic cable that has entered the wellbore. In order to maintain the integrity of the installation and performance thereof, parameters such as chemical species present, vibration, acoustic recognition, pressure, temperature, strain, and density may be queried by the optical demodulator 19 through fiber 17 directly or through integrated sensors. If done directly, monitoring may take place through monitoring point or distributed measurand along the equipment directly through the fiber itself using for example microbending (pressure) Raman Backscatter and optical time domain reflectometry (temperature). Examples of integrated sensor used include interferometry (all parameters) grating, (all parameters) florescence (mostly chemical species, viscosity and temperature) and photoelasticity (temperature, acceleration, vibration and rotational position). From the various measurements, progress and quality of the sand control process can be monitored. The system also provides a real time check on the sand control equipment and will alert surface personnel to problems before damage is done.

It should be noted that the optical fiber 17 can be outside the sand equipment as shown in FIG. 9 or inside as shown in FIG. 11 or can be in a separate tool (not shown) deliverable to the sand control equipment through the tubing. In any of these embodiments all of the parameters noted can be sensed and immediate knowledge of the conditions downhole are known at the surface.

Fiber Optic Monitoring of Sand Control Equipment

A method of actively monitoring the installation, integrity, and performance of sand control equipment for the control of unwanted fines that may occur during production, in a well. The instrument is comprised of optical fiber that is integral with, or attached to the inside or outside surfaces of the sand equipment. The optical fiber, or fibers, with or without integrated sensors, will monitor key parameters during the installation process to precisely locate the equipment in the well, monitor all aspects of the installation/completion process, including but not limited to adding aggregate, monitoring of the equipment and then monitoring the integrity and performance of the operational assembly. Typical parameters to be monitored include, but are not limited to chemical species, vibration, acoustic recognition of an event, pressure, temperature, strain, density, and vibration. An embodiment of the instrument is comprised of an optical fiber or fibers attached on the circumference of the sand control equipment in a configuration or pattern determined by the measurement point density desired. The optical fiber attaches to the equipment during the installation into the well. The optical fiber assembly can be comprised of bare optical fiber, or fibers, with or without a variety of coatings and buffers, or optical fiber(s) contained in a cable. The optical fiber assembly can be protected by installing the fiber in channels in the equipment or by the equipment having protuberances to keep the assembly from rubbing the wall of the well. The optical fiber assembly is connected to a fiber optic sensing demodulator either at the surface or at the wellhead. During installation, the exact depth of the sand control equipment can be determined by monitoring the length of the optical fiber from a known point to a location on the downhole equipment that has a discrete optical signature in the fiber. After the equipment is installed, the optical fiber is used to monitor the process of placement of aggregate material in the production interval(s). Through monitoring point or distributed measurand along the equipment, one method being to measure the pressure and temperature along the length of the equipment due to the aggregate being added, the operator can monitor and record the progress and quality of the process. Pressure measurements can be made using discrete sensors along microbending in the fiber or cable. Temperature along a fiber can be measured using combined Raman Backscatter and OTDR techniques. After the installation is complete and the well is in production, the optical fiber, with or without discrete sensors, can be used to monitor the performance and integrity of the sand control equipment and the production parameters of the well as a whole by monitoring point or distributed measurand.

Several embodiments of the fiber optic monitoring of Sand Control Equipment are possible:

1) The same as above embodiment, but the optical fiber(s), with or without discrete sensors, is built into the equipment. Connections between the equipment segments, can be implemented through connectors, splicing or any other means to communicate the data between equipment segments and the fiber optic sensing demodulator.
2) Install optical fiber in a tube that is integrated with the sand control equipment to monitor temperature along the length of the assembly to assess the aggregate filling process and operational integrity and performance of the system.
3) Along the length of the fiber in Embodiment 1, integrated acoustic sensors to monitor the acoustic signals associated with filling the equipment with aggregate to monitor the progress and quality of the process.
4) Install fibers the same as the previous embodiments, but use individual or combined measurements of pressure, temperature, acoustic, flow rate, chemical species, fluid density, fluid phase or other measurand to assess the completion process or operational integrity and performance of the installed equipment.
5) Substitute electrical sensors and systems for the fiber optic systems in the above embodiments to monitor the completion and operation of sand equipment.

Fiber Optic Monitoring of Sand Control Equipment via Tubing String

A method of actively monitoring the installation process, integrity and operational performance of sand control equipment, for the control of unwanted fines that may occur during production, with a fiber optic system that is placed in proximity to the equipment. The invention is comprised of optical fiber, with integrated distributed or point sensors, placed in proximity to the sand control equipment. The optical fiber is connected to a fiber optic sensing demodulator, to convert the light signals to measurement parameters, at the wellhead or surface. The optical fiber, or fibers, with or without integrated sensors, will monitor key parameters during the installation process to precisely locate the equipment in the well, monitor all aspects of the installation/completion process, including but not limited to adding aggregate, of the equipment and then monitoring the integrity and performance of the operational assembly. Typical parameters to be monitored include but are not limited to chemical species, vibration, acoustic emission, pressure, temperature, strain, density, and vibration.

The primary embodiment of the instrument is comprised of an optical fiber or fibers integrated with a tubing string that is installed into a well and located in the area of the sand control equipment. The optical fiber(s) and tubing string can be continuous, or connected in segments to provide length needed to reach the area of interest in the well. During the installation process, the integrity of the optical fiber can be monitored through, but not limited to, optical time domain reflectometry techniques. Once in place, the optical fiber(s) is connected to a fiber optic sensing demodulator either at the surface or at the well head. During installation, the exact depth of the sand control equipment can be determined by monitoring the length of optical fiber from a known point to a location on the downhole equipment that has a discrete optical signature in aggregate material in the production interval(s). Through monitoring point or distributed measurand along the equipment, one method being to measure the change in temperature along the length of the equipment due to the aggregate being added, the operator can monitor and record the progress and quality of the process. Temperature along a fiber can be measured using combined Raman Backscatter and OTDR techniques, as well as other methods. After the installation is complete and the well is in production, the optical fiber, with or without discrete sensors, can be used to monitor the performance and integrity of the sand control equipment and the production parameters as well as a whole by monitoring point or distributed measurand.

Several embodiments of the fiber optic monitoring of Sand Control Equipment are possible:

1) The same as primary embodiment, but the optical fiber(s), with or without discrete sensors, is located inside a continuous, closed loop, conduit side the tube. The optical fiber can be installed, or replaced, by blowing the optical fiber into the conduit.
2) Integrated acoustic sensors into the optical fiber to monitor the acoustic signals associated with the filling of the equipment with aggregate to monitor the progress and quality of the process.
3) Install a fiber optic sensing system into the tubing to provide individual or combined measurements of pressure, temperature, acoustic, flow rate, chemical species, fluid density, fluid phase or other measurand to assess the completion process, integrity or operational performance of the installed equipment.
4) Use tubing string, or other methods, to dock and undock optical fiber assembly (optical fiber and/or optical fiber cable) to docking point in the well's completion equipment and remove the tubing string. Optical fiber assembly will monitor parameters of interest in the well. The optical fiber assembly can be either retrieved later or left in place for the life of the assembly or well.
5) Substitute and/or combine electrical sensors and systems for the fiber optic systems in the above embodiments to monitor the completion, integrity and operation of sand control equipment.

The foregoing disclosure and description of the invention are illustrative and explanatory thereof, and various changes in the size, shape and materials, as well as in the details of the illustrated construction, may be made without departing from the spirit of the invention.

We claim:

1. A method of completion of a well, comprising:

attaching at least one auxiliary conduit or cable to a downhole assembly;

providing a connection to said conduit or cable;

running in said downhole assembly with said cable or conduit to a desired location in the well;

tagging into said downhole assembly and said connection of said conduit or cable downhole on at least one subsequent trip into the well with a tubular having at least one auxiliary cable or conduit extending along said tubular's length from the surface;

communicating through said auxiliary cable or conduit between the surface and the downhole assembly on a real time basis.

2. The method of claim 1, further comprising:

performing said tagging in without rotation.

3. The method of claim 2, further comprising:

selectively locking any connection resulting from said tagging in.

4. The method of claim 1, further comprising:

configuring said auxiliary conduit or cable adjacent said downhole assembly in a manor which permits monitoring or altering adjacent well conditions or the functioning of the downhole assembly.

5. The method of claim 1, further comprising:

using said auxiliary cable or conduit to operate at least a portion of said downhole assembly.

6. The method of claim 1, further comprising:

running at least one cable and at least one conduit auxiliary to the downhole assembly;

securing said cable to said conduit.

7. A method of completion of a well, comprising:

attaching at least one auxiliary conduit or cable to a downhole assembly;

providing a connection to said conduit or cable;

running in said downhole assembly with said cable or conduit to a desired location in the well;

tagging into said downhole assembly and said connection of said conduit or cable downhole on at least one subsequent trip into the well with a tubular having at least one auxiliary cable or conduit extending along its length from the surface;

communicating through said auxiliary cable or conduit between the surface and the downhole assembly on a real time basis;

tagging into said downhole assembly on a subsequent trip with production tubing having at least one auxiliary cable or conduit which is also connectable to said connection of said cable or conduit on the downhole assembly;

communicating during production through auxiliary cable or conduit between the surface and the downhole assembly on a real time basis.

8. A method of completion of a well, comprising:

attaching at least one auxiliary conduit or cable to a downhole assembly;

providing a connection to said conduit or cable;

running in said downhole assembly with said cable or conduit to a desired location in the well;

tagging into said downhole assembly and said connection of said conduit or cable downhole on at least one subsequent trip into the well with a tubular having at least one auxiliary cable or conduit extending along its length from the surface;

communicating through said auxiliary cable or conduit between the surface and the downhole assembly on a real time basis;

plugging said connection during said running in of the downhole assembly and auxiliary cable or conduit;

unplugging said connection with another trip into the well.

9. A method of completion of a well, comprising:
attaching at least one auxiliary conduit or cable to a downhole assembly;
providing a connection to said conduit or cable;
running in said downhole assembly with said cable or conduit to a desired location in the well;
tagging into said downhole assembly and said connection of said conduit or cable downhole on at least one subsequent trip into the well with a tubular having at least one auxiliary cable or conduit extending along its length from the surface;
communicating through said auxiliary cable or conduit between the surface and the downhole assembly on a real time basis;
configuring said auxiliary conduit or cable adjacent said downhole assembly in a manor which permits monitoring or altering adjacent well conditions or the functioning of the downhole assembly;
using a gravel pack screen and packer for said downhole assembly extending said cable or conduit through said packer to said connection.

10. The method of claim 9, further comprising:
delivering gravel through said at least one of conduits.

11. The method of claim 9, further comprising:
running in an outer jacket, assembled over said cable or conduit, together with said screen and packer.

12. The method of claim 9, further comprising:
running in at least one fiber optic cable on said screen;
using said fiber optic to determine fluid conditions flowing to said screen.

13. The method of claim 12, further comprising:
providing a winding inlet channel for inflow to said screen;
locating said fiber optic in said channel.

14. The method of claim 9, further comprising:
using a fiber optic cable to monitor the compaction of gravel per unit length of screen;
using a plurality of conduits for gravel deposition at different locations of said screen;
sensing downhole conditions during production through said screen using said fiber optic cable.

15. A method of completion of a well, comprising:
attaching at least one auxiliary conduit or cable to a downhole assembly;
providing a connection to said conduit or cable;
running in said downhole assembly with said cable or conduit to a desired location in the well;
tagging into said downhole assembly and said connection of said conduit or cable downhole on at least one subsequent trip into the well with a tubular having at least one auxiliary cable or conduit extending along said tubular's length from the surface;
communicating through said auxiliary cable or conduit between the surface and the downhole assembly on a real time basis;
using fiber optic as said cable.

16. A method of completion of a well, comprising:
attaching at least one auxiliary conduit or cable to a downhole assembly;
providing a connection to said conduit or cable;
running in said downhole assembly with said cable or conduit to a desired location in the well;
tagging into said downhole assembly and said connection of said conduit or cable downhole on at least one subsequent trip into the well with a tubular having at least one auxiliary cable or conduit extending along its length from the surface;
communicating through said auxiliary cable or conduit between the surface and the downhole assembly on a real time basis;
using fiber optic as said cable;
using said fiber optic to measure a downhole condition on or about said downhole assembly.

17. A method of completion of a well, comprising:
attaching at least one auxiliary conduit or cable to a downhole assembly;
providing a connection to said conduit or cable;
running in said downhole assembly with said cable or conduit to a desired location in the well;
tagging into said downhole assembly and said connection of said conduit or cable downhole on at least one subsequent trip into the well with a tubular having at least one auxiliary cable or conduit extending along said tubular's length from the surface; communicating through said auxiliary cable or conduit between the surface and the downhole assembly on a real time basis;
running said auxiliary conduit or cable in a U-shaped path so as to provide a pair of connections;
extending said U-shaped path to the surface as a result of said tagging, an auxillary conductor or cable attached to a tubular run in from the surface, into a respective connection on a subsequent trip into the wellbore.

18. A method of completion of a well, comprising:
attaching at least one auxiliary conduit or cable to a downhole assembly;
providing a connection to said conduit or cable;
running in said downhole assembly with said cable or conduit to a desired location in the well;
tagging into said downhole assembly and said connection of said conduit or cable downhole on at least one subsequent trip into the well with a tubular having at least one auxiliary cable or conduit extending along said tubular's length from the surface;
communicating through said auxiliary cable or conduit between the surface and the downhole assembly on a real time basis;
providing an external through on said downhole assembly;
mounting a fiber optic cable in said through.

19. The method of claim 18, further comprising:
securely mounting said fiber optic cable to said through to allow real time sensing of a downhole condition on or about the downhole assembly.

20. A method of completion of a well, comprising:
attaching at least one auxiliary conduit or cable to a downhole assembly;
providing a connection to said conduit or cable;
running in said downhole assembly with said cable or conduit to a desired location in the well;
tagging into said downhole assembly and said connection of said conduit or cable downhole on at least one subsequent trip into the well with a tubular having at least one auxiliary cable or conduit extending along its length from the surface;
communicating through said auxiliary cable or conduit between the surface and the downhole assembly on a real time basis;
mounting a fiber optic cable inside said conduit.

* * * * *